US006472649B2

(12) United States Patent
Lee et al.

(10) Patent No.: US 6,472,649 B2
(45) Date of Patent: Oct. 29, 2002

(54) MICROWAVE OVEN AND METHOD OF CONTROLLING THE SAME

(75) Inventors: Sung-ho Lee; Young-won Cho, both of Suwon; Tae-soo Kim, Seoul, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/887,063

(22) Filed: Jun. 25, 2001

(65) Prior Publication Data

US 2002/0066730 A1 Jun. 6, 2002

(30) Foreign Application Priority Data

Dec. 6, 2000 (KR) ..... 00-73920

(51) Int. Cl.[7] ..... H05B 6/68
(52) U.S. Cl. ..... 219/702; 219/715
(58) Field of Search ..... 219/702, 715, 219/716, 719, 721, 761, 720, 710; 363/132

(56) References Cited

U.S. PATENT DOCUMENTS 4,742,442 A 5/1988 Nilssen
4,835,353 A 5/1989 Smith et al.
4,967,051 A * 10/1990 Maehara et al. ..... 219/721
5,286,938 A * 2/1994 Takei et al. ..... 219/715
6,111,240 A * 8/2000 Kishimoto et al. ..... 219/720

FOREIGN PATENT DOCUMENTS

KR 0122727 9/1997

* cited by examiner

*Primary Examiner*—Teresa Walberg
*Assistant Examiner*—Quang Van
(74) *Attorney, Agent, or Firm*—Robert E. Bushnell, Esq.

(57) ABSTRACT

A method for controlling a microwave oven including a power supply part supplying an AC power, a high voltage transformer generating a high voltage with the AC power generated from the power supply part, a magnetron generating electromagnetic waves with the high voltage generated from the high voltage transformer, and a control signal generator part supplying a control signal to the magnetron, the method including the steps of: setting up a reference oscillation time; measuring the time when the magnetron starts being oscillated according to the control signal; comparing the reference oscillation time with the oscillation start time; and adjusting a pulse width of the control signal where the reference oscillation time is longer than the oscillation start time. With this configuration, the temporary surge operation and the noise generation can be lowered in the hot state, thereby serving to enhance a stability of the circuit.

12 Claims, 6 Drawing Sheets

MICROWAVE OVEN AND METHOD OF CONTROLLING THE SAME

CLAIM OF PRIORITY

This application makes reference to, incorporates the same herein, and claims all benefits accruing under 35 U.S.C. §6119 from my application entitled MICROWAVE OVEN AND CONTROL METHOD THEREOF filed with the Korean Industrial Property Office on Dec. 6, 2000 and there duly assigned Serial No. 2000-73920.

BACKGROUND OF THE INVENTION

1. Field of the Invention

The present invention relates to a microwave oven and a method of controlling the same, and more particularly, to a microwave oven and a method of controlling the same, wherein a control signal generator part is controlled based on an oscillation time of a magnetron.

2. Description of the Related Art

Generally, a microwave oven is operated in the following manner. An alternating current (AC) power supplied from a power supply part is applied to a primary coil of an iron-core high voltage transformer so as to generate a high voltage at a secondary coil. The high voltage generated at the secondary coil of the high voltage transformer serves to heat a cathode filament provided in a magnetron and a very high frequency (VHF) energy is emitted from the magnetron oscillated by the applied high voltage. The VHF energy is transformed into heat energy when it encounters water or moisture or an object having water (e. g., food ingredients, etc.) within a closed space, thereby being able to perform a cooking operation.

FIG. 5 is a schematic control block diagram according to a conventional microwave oven. As shown therein, the conventional microwave oven includes a power supply part 101 supplying an AC power, a magnetron 109 generating electromagnetic waves by a high voltage generated from a high voltage transformer 107, a rectifier and smoother part 103 rectifing and smoothing the AC power, an inverter part 105 converting a direct current (DC) power from the rectifier and smoother part 103 into an AC power having a high frequency, a high voltage transformer 107 generating a high voltage by the AC power supplied through the power supply part 101, the rectifier and smoother part 103 and the inverter part 105 sequentially, a control signal generator part 127 generating a control signal, and a controller part 115 positioned between the inverter part 105 and the signal generator part 127.

The controller part 115 includes a D/A (digital/analog) converter part 125 for converting the control signal generated from the control signal generator part 127 and detected from the resonance detector part 121 into an analog signal and applying the converted control signal to an output control or controller part 119, the output controller part 119 controlling to output a frequency of the control signal detected by the resonance detector part 121, and an oscillator part 117 for changing a cycle of the control signal according to the frequency of the control signal outputted from the output controller part 119 and inputs the changed cycle into the inverter part 105. The controller part 115 further includes an on-off starter part 123 for controlling an on-off operation of the oscillator part 117 according to the control signal generated from the signal generator part 127 and controlling a soft start of the oscillator part 117.

Hereinafter, the related art will be described with reference to FIG. 6 which is a graph showing waveforms of a control signal from a conventional microwave oven. Referring to this figure, a control signal is applied to the magnetron 109, the control signal having the same width of pulse in a cold state, when the magnetron is driven at first after the oven is manufactured or the magnetron has not been operated for a predetermined period of time, and in a hot state, when a filament of the magnetron 109 is heated to a predetermined degree of temperature over the predetermined temperature.

Where the same control signal is applied in the hot state, a relatively large amount of electric current is applied, when the filament of the magnetron is heated over the predetermined temperature, thereby generating a condition of surge temporarily. In other words, over-current and/or over-voltage are generated, which causes a stability of the circuit to be lowered. Also, this causes the magnetron to be overloaded, generating a condition of noise temporarily.

SUMMARY OF THE INVENTION

Accordingly, the present invention has been made keeping in mind the above-described shortcomings, and an object of the present invention is to provide a microwave oven and a method for controlling the same, wherein surge and/or noise can be controlled on the basis of the time of oscillation of the magnetron.

This and other objects of the present invention may be accomplished by the provisions of a method for controlling a microwave oven including a power supply part supplying an AC power, a high voltage transformer generating a high voltage with the AC power generated from the power supply part, a magnetron generating electromagnetic waves with the high voltage generated from the high voltage transformer, and a control signal generator part supplying a control signal to the magnetron, including the steps of: setting up a reference oscillation time; measuring the time when the magnetron starts being oscillated according to the control signal; comparing the reference oscillation time with the oscillation start time; and adjusting a pulse width of the control signal where the reference oscillation time is longer than the oscillation start time.

Preferably, the step of setting up the reference oscillation time includes the substeps of: setting up an arbitrary oscillation time as a set-up oscillation time; measuring the oscillation start time of the magnetron; comparing the set-up oscillation time with the oscillation start time; and adjusting the set-up oscillation time so as to be equal to the oscillation start time where the set-up oscillation time is longer or shorter than the oscillation start time, and setting the adjusted set-up oscillation time as the reference oscillation time.

Effectively, the method further includes the step of: setting the set-up oscillation time as the reference oscillation time if the set-up oscillation time is equal to the oscillation start time.

According to another aspect of the present invention, the above and other objects may also be accomplished by the provision of the microwave oven including a power supply part supplying an AC power, a high voltage transformer generating a high voltage with the AC power generated from the power supply part, and a magnetron generating electromagnetic waves with the high voltage generated from the high voltage transformer, including: a control signal generator part generating a control signal with a predetermined pulse width; a counter counting the time when the magnetron starts being oscillated according to the control signal; and a controller part adjusting the pulse width of the control signal where the oscillation start time counted by the counter is shorter than a predetermined reference oscillation time.

Preferably,the controller part compares the set-up oscillation time with the oscillation start time of the magnetron, adjusts the set-up oscillation time so as to be equal to the oscillation start time where the set-up oscillation time is longer or shorter than the oscillation start time, and setting the adjusted set-up oscillation time as the reference oscillation time.

Effectively, the controller part sets the set-up oscillation time as the reference oscillation time where the set-up oscillation time is equal to the oscillation start time.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
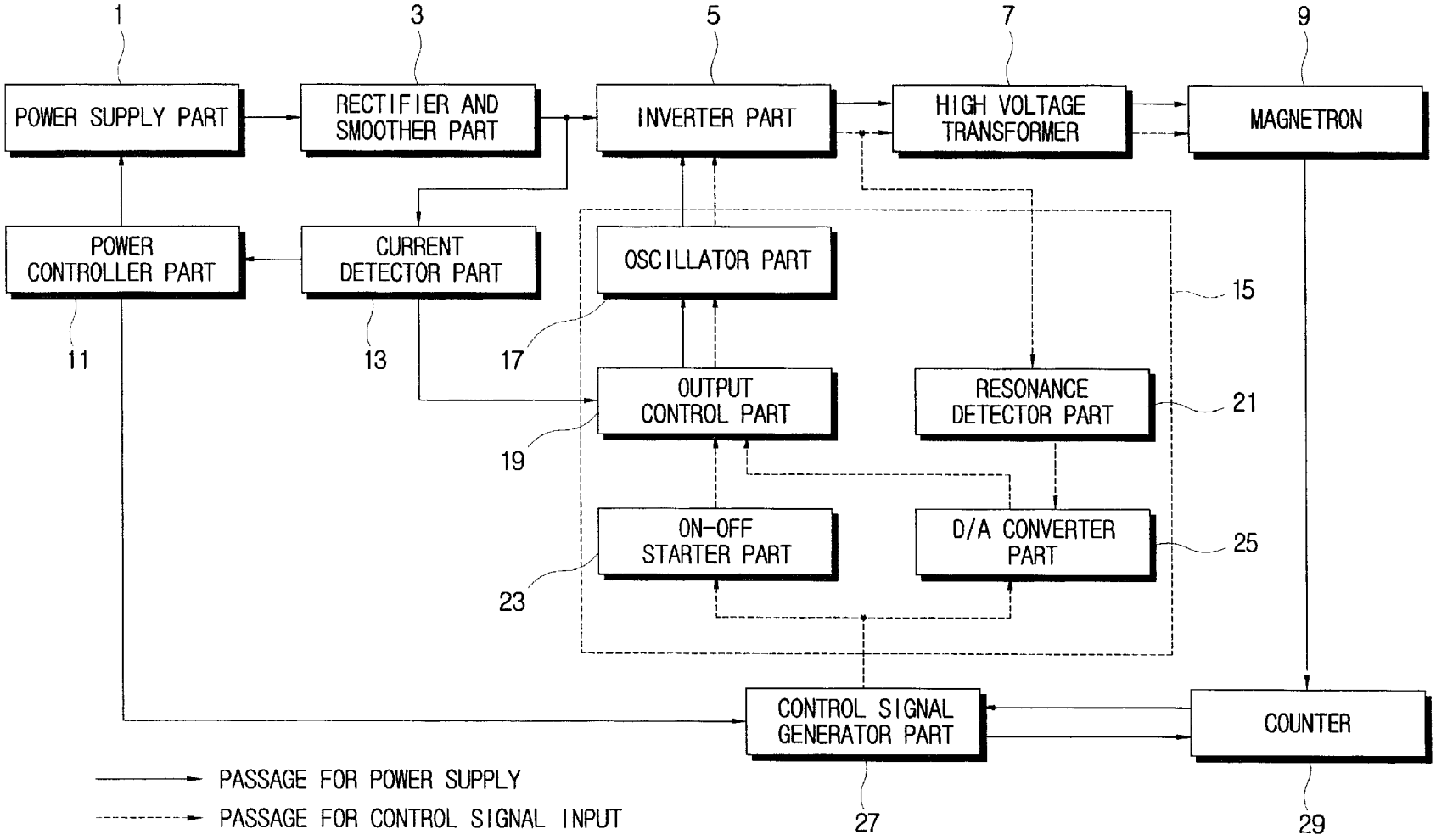
FIG. 1 is a control block diagram of a microwave oven according to the present invention.

Referring to FIG. 1 which is a control block diagram of a microwave oven according to the present invention, the microwave oven includes a power supply part 1 supplying an alternating current (AC) power, a high voltage transformer 7 generating a high voltage with the AC power supplied from the power supply part 1, a magnetron 9 generating electromagnetic waves with the high voltage generated from the high voltage transformer 7, a current detector part 13 determining whether a current value of the power inputted from the high voltage transfor mer 7 exceeds a predetermined allowable current value, and a power controller part 11 interrupting the input power to the magnetron 9 where the current value is in excess of the allowable current value and resuming an operation of the magnetron 9 after a predetermined period of time for recess has passed.

The microwave oven according to the present invention further includes a rectifier and smoother part 3 rectifying and smoothing the AC power, an inverter part 5 converting a direct current (DC) power from the rectifier and smoother part 3 into an AC power of the high voltage, a control signal generator part 27 generating a control signal, a controller part 15 determining whether a current value of the DC power from the rectifier and smoother part 3 exceeds the predetermined allowable current value, and interrupting the input power to the magnetron 9 where the current value is in excess of the allowable current value and resuming an operation of the magnetron 9 after a predetermined period of time for recess has passed.

Still, the present microwave oven further includes a counter 29 counting the time when the magnetron 9 starts being oscillated according to the control signal generated from the control signal generator part 27. The controller part 15 controls a pulse width of the control signal where the oscillation start time counted by the counter 29 is shorter than a predetermined reference oscillation start time.

In addition, the controller part 15 includes a digital/analog (D/A) converter part 25 converting the control signal generated from the control signal generator part 27 and detected from the resonance detector part 21 into an analog signal and applying the converted control signal to an output controller or control part 19, the output control part 19 controlling and outputting a frequency of the control signal detected by the resonance detector part 21, and an oscillator part 17 changing a cycle of the control signal according to the frequency thereof outputted from the output control part 19 and inputting the changed cycle into the inverter part 5. The controller part 15 further includes an on-off starter part 23 controlling on and/or off operations of the oscillator part 17 according to the control signal generated from the control signal generator part 27 and controlling an on-off operation and a soft start of the oscillator part 17.

Figure 2:
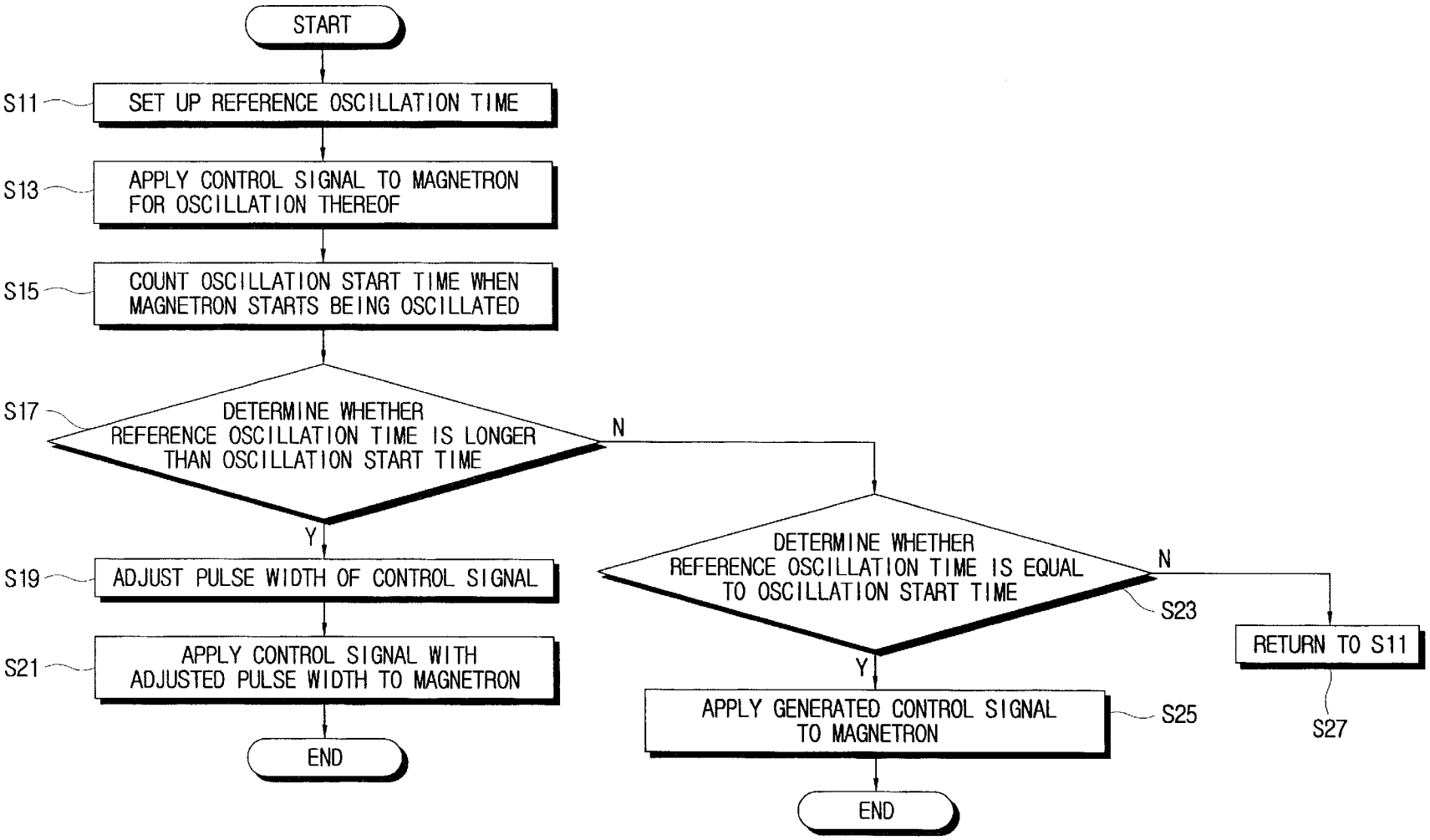
FIG. 2 is a flow chart showing a control process of the microwave oven of FIG. 1.
Figure 3:
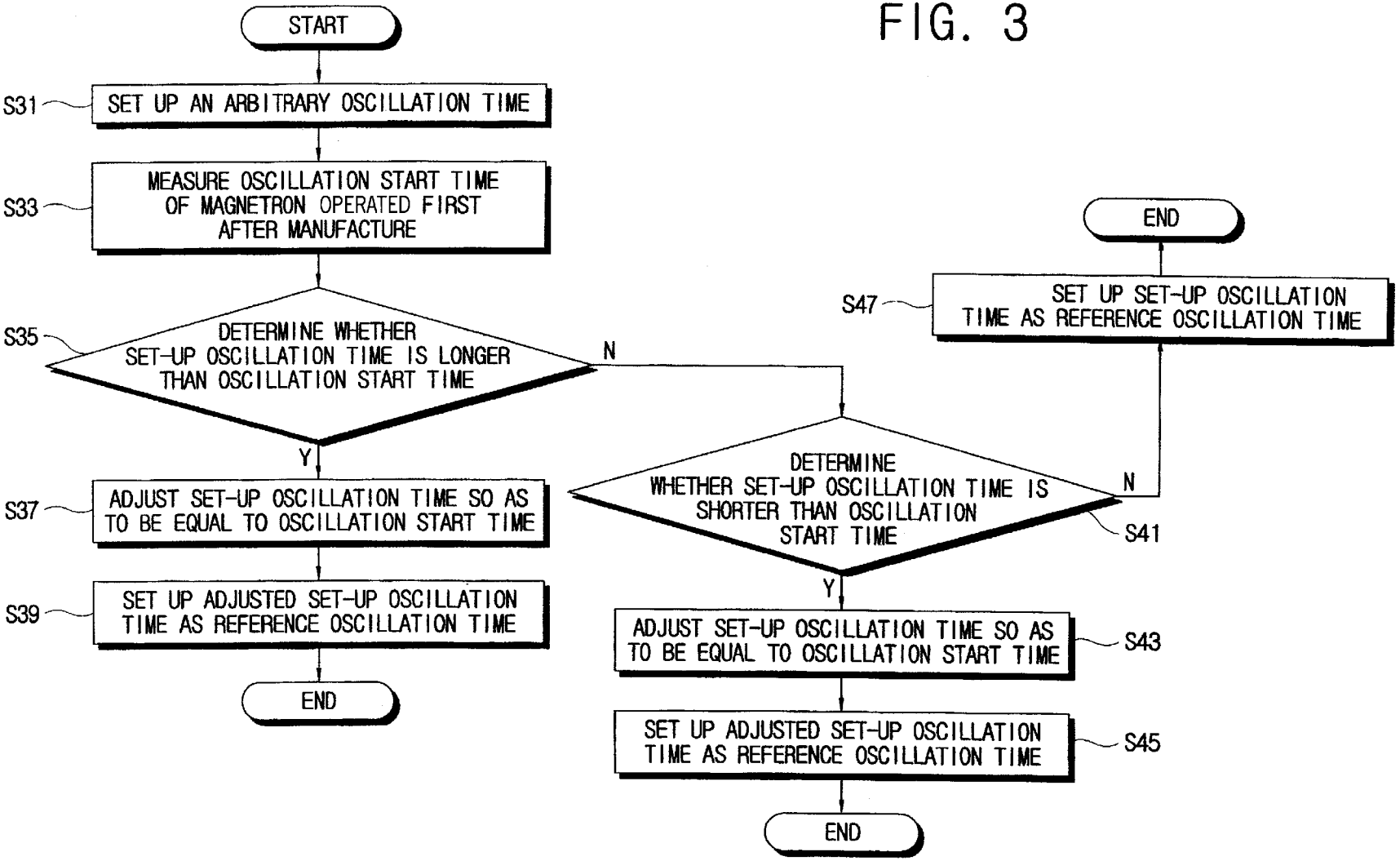
FIG. 3 is a flow chart showing in detail a step of setting up a reference oscillation time in the control process of FIG. 2.

FIG. 2 is a flow chart showing a control process of the microwave oven of FIG. 1 and FIG. 3 is a flow chart showing in detail a step of setting up a reference oscillation time of FIG. 2. As illustrated in these figures, a user first sets up a reference oscillation time (S11). If a control signal is generated from the control signal generator part 27, the controller part 15 applies the power supplied from the power supply part I for oscillation of the magnetron 9 and the control signal, to the magnetron 9 (S13). The counter 29 counts the time when oscillation of the magnetron starts, after the application of the control signal (S15). The controller part 15 compares the oscillation start time counted by the counter 29 with the reference oscillation time to determine whether the oscillation time is shorter than the reference oscillation time (S17). Where the oscillation start time is shorter than the reference oscillation time, the controller part 15 adjusts the pulse width of the control signal generated from the control signal generator part 27 so as to become narrower (S19). When the pulse width is adjusted, the adjusted control signal is applied to the magnetron 9 (S21).

In the step S17, where the oscillation start time is not shorter than the reference oscillation time, the controller part 15 compares them to determine whether the reference oscillation time is equal to the oscillation start time (S23). If they are equal, the generated control signal is applied to the magnetron 9 (S25). In the step S23, where the oscillation start time is not equal to the reference oscillation time, the controller part 15 determines that the oscillation start time is longer than the reference oscillation time, and then, it returns to the step of setting up the reference oscillation time (S27).

In the step S11 of setting up the reference oscillation time, an arbitrary oscillation time may be set up as depicted in FIG. 3 (S31). After the oscillation time is set up, the start time of the first oscillation after manufacture of the magnetron is measured (S33). The controller part 15 compares the set-up oscillation time with the first oscillation start time (S35). Where the set-up oscillation time is longer than the first oscillation start time, the set-up oscillation time is adjusted by the controller part 15 so as to be equal to the first oscillation start time (S37). The adjusted set-up oscillation time is set as a reference oscillation time S39, and then, the control process after the step S13 is performed.

Where the set-up oscillation time is not longer than the first oscillation start time, the set-up oscillation time is compared with the first oscillation start time so as to determine whether the set-up oscillation time is shorter than the first oscillation start time (S41). Where it is determined that the set-up oscillation time is shorter than the first oscillation start time, the set-up oscillation time is adjusted by the controller part 15 so as to be equal to the first oscillation start time of the magnetron (S43). The adjusted set-up oscillation time is set as a reference oscillation time (S45), and then, the control process after the step S13 is performed. Where the set-up oscillation time is equal to the first oscillation start time, the set-up oscillation time is set as the reference oscillation time (S47), and then, the step of comparing it with the oscillation start time of the magnetron 9 is performed.

Hereinafter, the control process will be described with reference to FIG. 4 which shows graphs showing waveforms of a control signal from the microwave oven according to the present invention. As shown therein, where the oscillation start time is shorter than the reference oscillation time in comparison with them, the pulse width of the control signal generated from the control signal generator part 27 is reduced in the hot state wherein the predetermined period of time has not passed after performing an oscillation operation of the magnetron 9.

Figure 4:
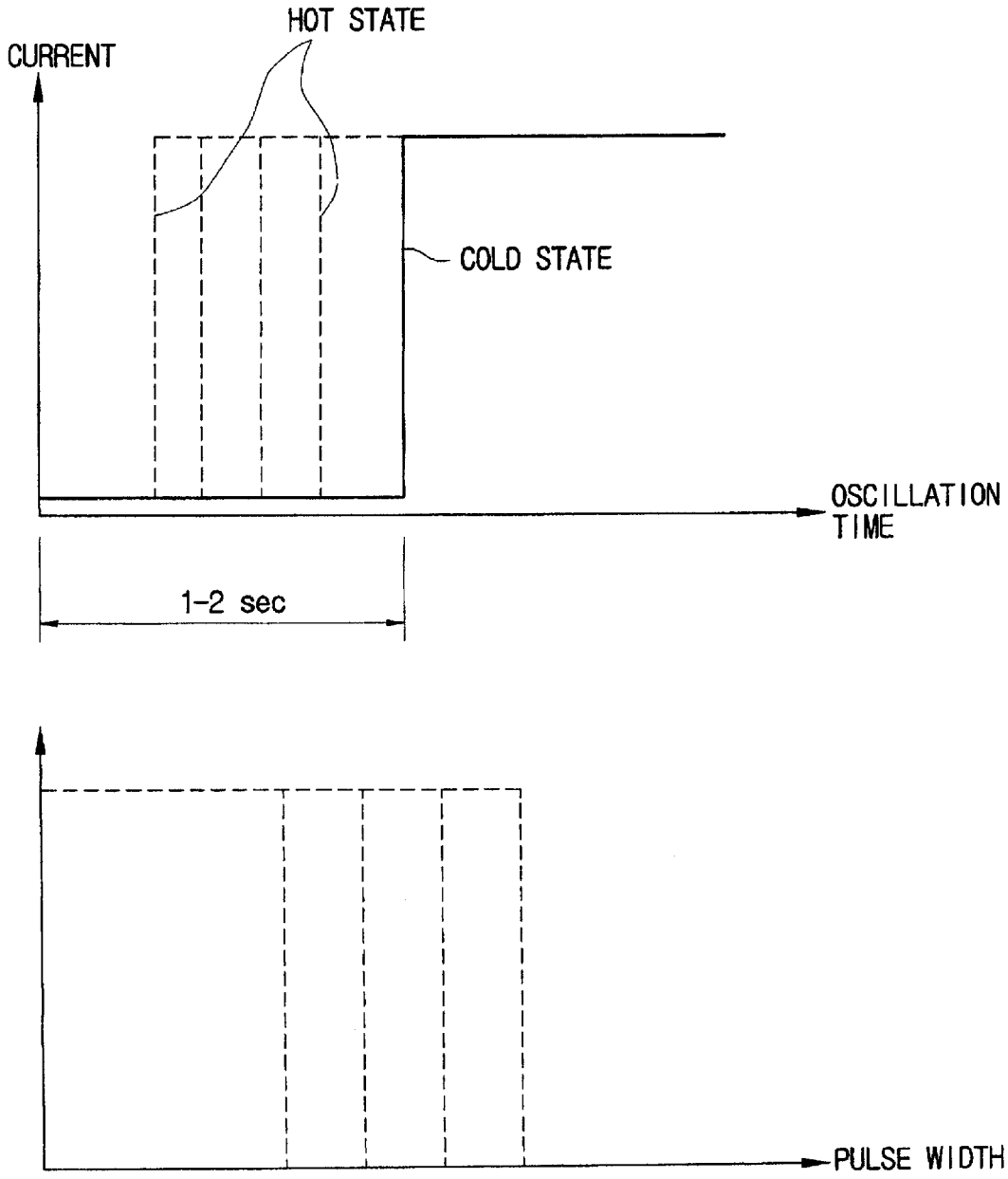
FIG. 4 shows graphs showing waveforms of a control signal from the microwave oven according to the present invention.
Figure 5:
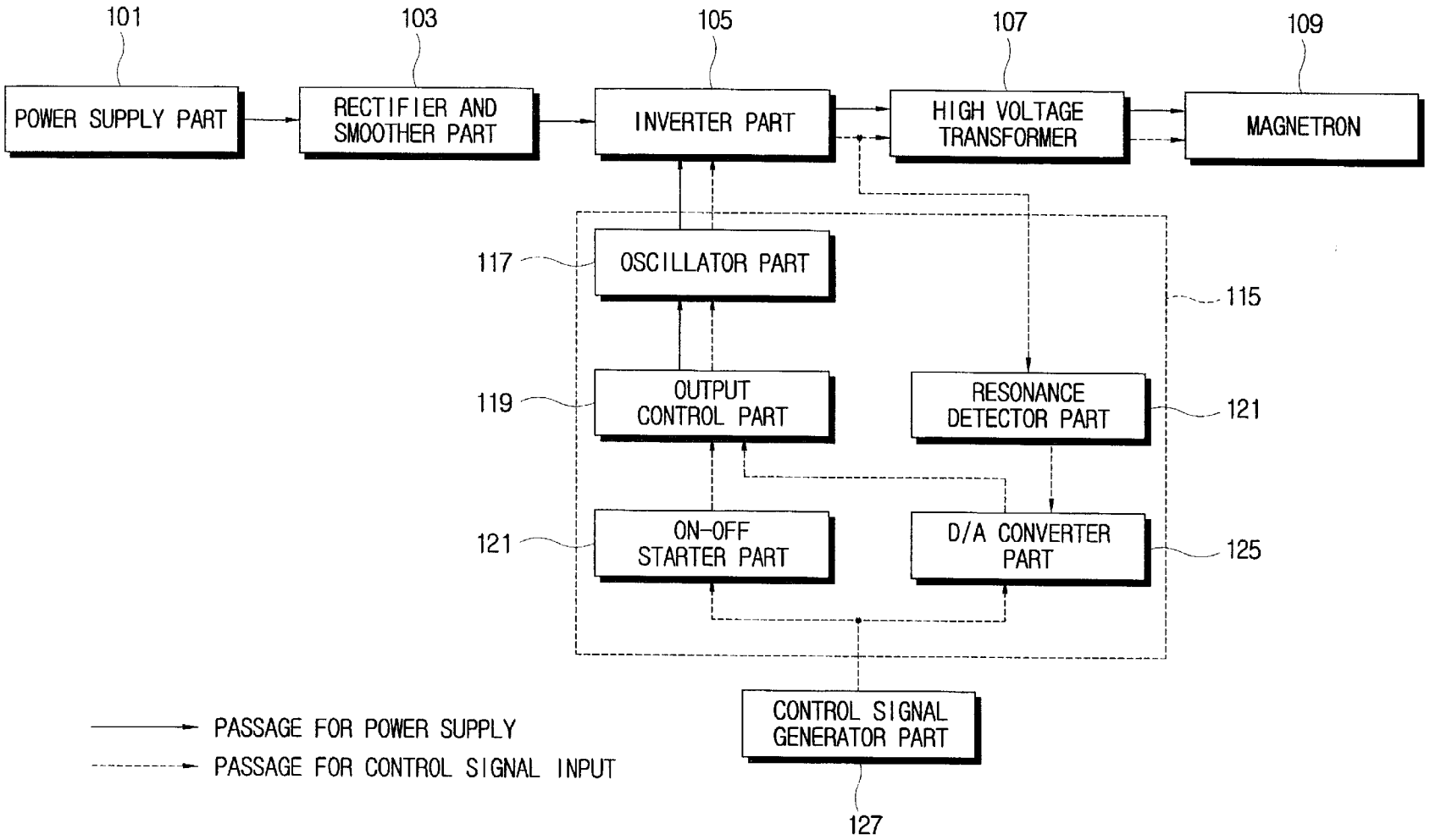
FIG. 5 (PRIOR ART)
FIG. 5 is a control block diagram of a conventional microwave oven.
Figure 6:
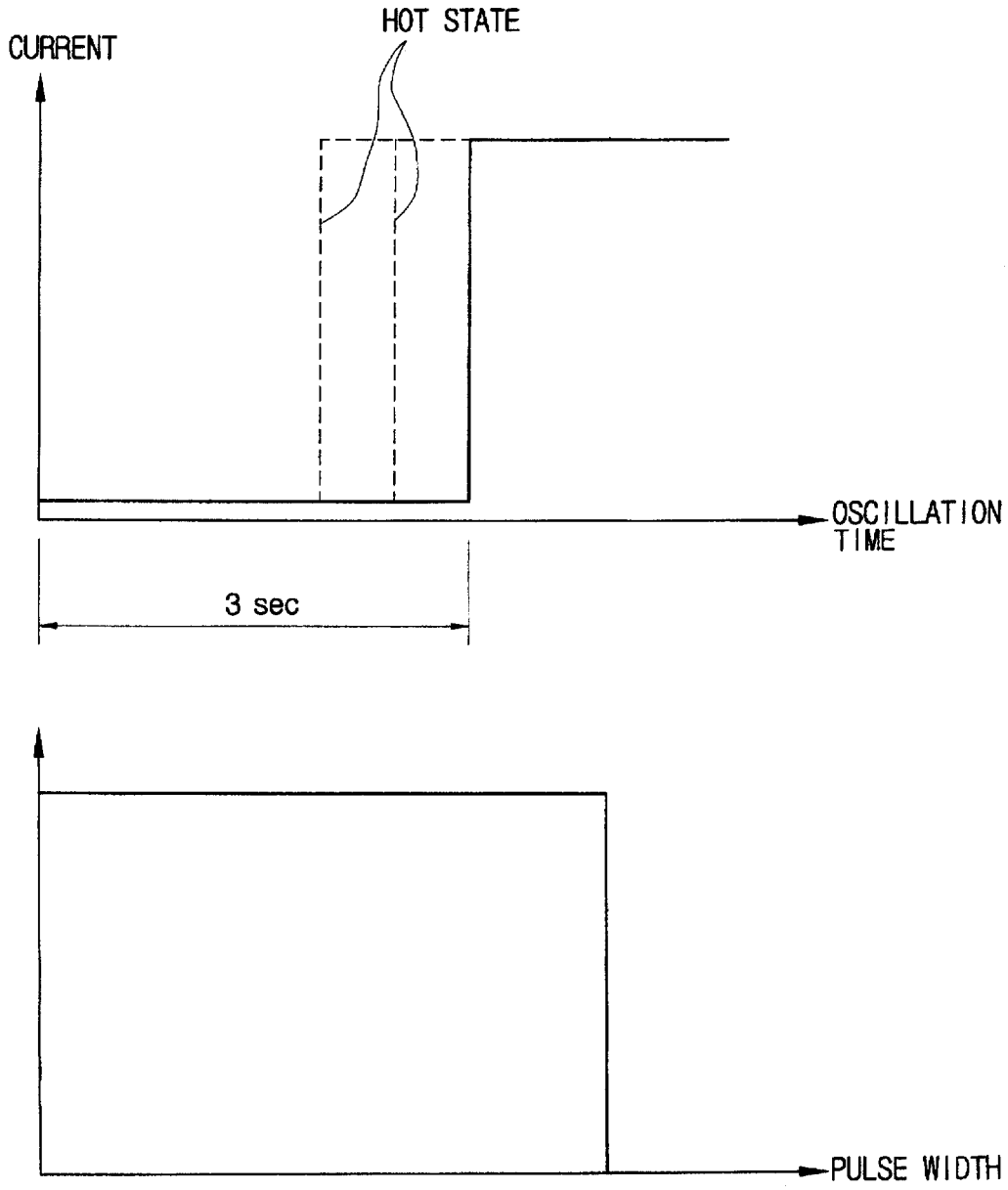
FIG. 6 (PRIOR ART)
FIG. 6 is a graph showing waveforms of a control signal from a conventional microwave oven.

However, as illustrated in FIGS. 3 and 4, where the magnetron is driven at first after the oven is manufactured or the magnetron has not been operated for a predetermined period o f time, that is, it is in the cold state, the controller part 15 adjusts the set-up oscillation time so as to be equal to the first oscillation start time and sets it as the reference oscillation time.

As described above, according to the present invention, the temporary surge operation and the noise generation can be lowered in the hot state, that is, when the filament of the magnetron is heated to a predetermined degree of temperature over the predetermined temperature, thereby serving to enhance a stability of the circuit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for controlling a microwave oven, the microwave oven including a power supply part for supplying an alternating current (AC) power, a high voltage transformer for generating a high voltage with the alternating current (AC) power generated from the power supply part, a magnetron for generating electromagnetic waves with the high voltage generated from the high voltage transformer, and a control signal generator part for supplying a control signal to the magnetron, comprising the steps of:

setting up a reference oscillation time;

measuring a time when the magnetron starts being oscillated according to the control signal as an oscillation start time;

comparing the reference oscillation time with the oscillation start time; and adjusting a pulse width of the control signal when the reference oscillation time is longer than the oscillation start time.

2. The method according to claim 1, further comprised of the step of setting up the reference oscillation time comprises the substeps of:

setting up an arbitrary oscillation time as a set-up oscillation time for the reference oscillation time;

measuring the oscillation start time of the magnetron;

comparing the set-up oscillation time with the oscillation start time; and adjusting the set-up oscillation time to provide an adjusted set-up oscillation time equal to the oscillation start time when the set-up oscillation time is longer or shorter than the oscillation start time, and setting the adjusted set-up oscillation time as the reference oscillation time when the set-up oscillation time is adjusted.

3. The method according to claim 2, further comprising the step of: setting the set-up oscillation time as the reference oscillation time when the set-up oscillation time is equal to the oscillation start time.

4. A microwave oven, comprising:

a power supply part for supplying an alternating current (AC) power;

a high voltage transformer for generating a high voltage with the alternating current (AC) power generated from the power supply part;

a magnetron for generating electromagnetic waves with the high voltage generated from the high voltage transformer;

a control signal generator part for generating a control signal with a predetermined pulse width;

a counter for counting a time when the magnetron starts being oscillated according to the control signal as an oscillation start time; and a controller part for adjusting the predetermined pulse width of the control signal when the oscillation start time counted by the counter is shorter than a predetermined reference oscillation time.

5. The microwave oven according to claim 4, further comprised of the controller part for setting up the predetermined reference oscillation time by comparing a set-up oscillation time for the predetermined reference oscillation time with the oscillation start time of the magnetron, for adjusting the set-up oscillation time to provide an adjusted set-up oscillation time equal to the oscillation start time when the set-up oscillation time is longer or shorter than the oscillation start time, and for setting the adjusted set-up oscillation time as the predetermined reference oscillation time when the set-up oscillation time is adjusted.

6. The microwave oven according to claim 5, further comprised of he controller part for setting the set-up oscillation time as the predetermined reference oscillation time when the set-up oscillation time is equal to the oscillation start time.

7. A method for controlling a microwave oven, the microwave oven including a power supply part for supplying an alternating current (AC) power, a high voltage transformer for generating a high voltage with the alternating current (AC) power generated from the power supply part, a magnetron for generating electromagnetic waves with the high voltage generated from the high voltage transformer, and a control signal generator part for supplying a control signal to the magnetron, comprising the steps of:

setting up a reference oscillation time;

measuring a time when the magnetron starts being oscillated according to the control signal as an oscillation start time;

comparing the reference oscillation time with the oscillation start time; and adjusting a pulse width of the control signal when the reference oscillation time is other than the oscillation start time.

8. The method according to claim 7, further comprised of the step of setting up the reference oscillation time comprises the substeps of:

setting up an arbitrary oscillation time as a set-up oscillation time for the reference oscillation time;

measuring the oscillation start time of the magnetron;

comparing the set-up oscillation time with the oscillation start time; and adjusting the set-up oscillation time to provide an adjusted set-up oscillation time equal to the oscillation start time when the set-up oscillation time is longer or shorter than the oscillation start time, and setting the adjusted set-up oscillation time as the reference oscillation time when the set-up oscillation time is adjusted.

9. The method according to claim 8, further comprising the step of: set ting the set-up oscillation time as the reference oscillation time when the set-up oscillation time is equal to the oscillation start time.

10. A microwave oven, comprising:

a power supply part for supplying an alternating current (AC) power;

a high voltage transformer for generating a high voltage with the alternating current (AC) power generated from the power supply part;

a magnetron for generating electromagnetic waves with the high voltage generated from the high voltage transformer;

a control signal generator part for generating a control signal with a predetermined pulse width;

a counter for counting a time when the magnetron starts being oscillated according to the control signal as an oscillation start time; and a controller part for adjusting the predetermined pulse width of the control signal when the oscillation start time counted by the counter is other than a predetermined reference oscillation time.

11. The microwave oven according to claim 10, further comprised of the controller part for setting up the predetermined reference oscillation time by comparing a set-up oscillation time for the predetermined reference oscillation time with the oscillation start time of the magnetron, for adjusting the set-up oscillation time to provide an adjusted set-up oscillation time equal to the oscillation start time when the set-up oscillation time is longer or shorter than the oscillation start time, and for setting the adjusted set-up oscillation time as the predetermined reference oscillation time when the set-up oscillation time is adjusted.

12. The microwave oven according to claim 11, further comprised of the controller part for setting the set-up oscillation time as the predetermined reference oscillation time when the set-up oscillation time is equal to the oscillation start time.

* * * * *